US005853545A

United States Patent [19]

Haraldsson et al.

[11] Patent Number: 5,853,545

[45] Date of Patent: Dec. 29, 1998

[54] ARRANGEMENT FOR FEEDING STOCK TO A HEADBOX IN A PAPERMAKING MACHINE

[75] Inventors: N. Ulf A. Haraldsson, Karlstad, Sweden; Jyrki M. Huovila, Muurame, Finland; Ingvar B. E. Klerelid; Louise M. Törnefalk, both of Karlstad, Sweden

[73] Assignee: Valmet-Karlstad AB, Karlstad, Sweden

[21] Appl. No.: 811,888

[22] Filed: Mar. 7, 1997

Related U.S. Application Data

[60] Provisional application No. 60/022,464 Aug. 9, 1996.

[30] Foreign Application Priority Data

Mar. 8, 1996 [SE] Sweden ..... 9600943

[51] Int. Cl.[6] ..... D21F 1/08

[52] U.S. Cl. ..... 162/343; 162/337; 162/338; 162/258

[58] Field of Search ..... 162/336, 337, 162/338, 343, 258

[56] References Cited

U.S. PATENT DOCUMENTS

| | | | |
|---|---|---|---|
| 3,878,039 | 4/1975 | Descary et al. | 162/336 |
| 4,897,158 | 1/1990 | Weisshuhn et al. | 162/259 |
| 5,147,509 | 9/1992 | Kuragasaki et al. | 162/336 |
| 5,196,091 | 3/1993 | Hergert | 162/258 |
| 5,316,383 | 5/1994 | Begemann et al. | 366/160 |
| 5,626,722 | 5/1997 | Huovila | 162/258 |
| 5,688,374 | 11/1997 | Begemann et al. | 162/336 |
| 5,709,777 | 1/1998 | Begemann et al. | 162/338 |

FOREIGN PATENT DOCUMENTS

| | | |
|---|---|---|
| 0 635 599 A1 | 1/1995 | European Pat. Off. . |
| 0 635 600 A1 | 1/1995 | European Pat. Off. . |

*Primary Examiner*—Karen M. Hastings
*Attorney, Agent, or Firm*—Bell Seltzer Intellectual Property Law Group of Alston & Bird, LLP

[57] ABSTRACT

An arrangement for feeding stock to a headbox in a papermaking machine which comprises at least one stock header with an inlet for receiving stock into the header and a plurality of stock header outlets permitting stock to leave the header. For each stock header outlet there is a stock conduit downstream of the stock header outlet permitting stock to pass from the stock header outlet, through the conduit to the inlet of the headbox. The arrangement includes a dilution header for feeding a diluent such as water to a plurality of stock conduits. The dilution header has an inlet for receiving a diluent into the dilution header and a plurality of outlets permitting the diluent to leave the dilution header. For each dilution header outlet, there is a diluent conduit permitting the passage of a diluent from the dilution header into a stock conduit. According to the invention, the diluent is fed into a stock conduit at a location immediately downstream of a stock header outlet and the stock header together with the stock header outlets is designed such that the velocity of the stock flowing through the stock header is substantially equal to the velocity of the stock in an upstream end of the stock conduits.

3 Claims, 4 Drawing Sheets

ARRANGEMENT FOR FEEDING STOCK TO A HEADBOX IN A PAPERMAKING MACHINE

CROSS REFERENCE TO RELATED APPLICATIONS

This application is related to commonly owned copending Provisional Application Ser. No. 60/022,464 filed Aug. 9, 1996, and claims the benefits of its earlier filing date under 35 U.S.C.§119(e).

FIELD OF THE INVENTION

The present invention relates to papermaking machines and more particularly relates to headboxes of papermaking machines wherein the stock can be diluted.

BACKGROUND OF THE INVENTION

In the art of papermaking, stock is discharged from a headbox through a slice lip onto a forming wire. On the forming wire, water is drained from the stock so that a web is formed on the wire. The stock is fed to the headbox from an upstream stock header which delivers stock at high pressure to the headbox. When stock is fed to a headbox in a papermaking machine, the stock is commonly fed from the stock header to the headbox in a number of separate conduits leading to the inlet of the headbox and connected to the inlet of the headbox at a number of evenly spaced connection points arranged in a straight row that extends in a cross machine direction. In this manner, the stock supplied to the headbox will be evenly distributed in the cross machine direction in order to ensure that the stock discharged from the headbox is uniformly distributed in the cross machine direction such that the paper web produced by the papermaking machine will have uniform properties, such as basis weight and fiber orientation, across the web width.

However, during the papermaking process, inadequacies due to the construction of the papermaking machine as well as physical phenomena will result in a failure to achieve uniform properties across the web and the paper web produced will have non-uniform properties across its width. In order to compensate for such non-uniformities, it is a common practice to regulate in the cross-machine direction the volume of stock discharged from the headbox. A well-known way of achieving this is to employ in the headbox a slice lip which is locally adjustable. By varying the opening of the slice lip in a cross-machine direction, it is possible to adjust in a cross-machine direction the volume of stock discharged from the headbox. However, this method of regulating the stock flow from the headbox has the disadvantage that when the flow of stock is altered at a point across the slice lip, this change will cause crossflows that will affect both basis weight and fiber orientation. In order to overcome this problem, it has been proposed that the stock fed to the headbox can be selectively diluted in such a way that a diluent is fed into at least some of the conduits through which the stock is fed to the headbox. By regulating the amount of diluent fed into each conduit, it is possible to compensate for basis weight variations in the cross-machine direction. Arrangements for selectively diluting the stock fed to the headbox are disclosed in, e.g., U.S. Pat. No. 5,196,091 (Hergert) and U.S. Pat. No. 4,897,158 (Weisshuhn et al.).

When such an arrangement is used, a flow of stock will meet and mix with a flow of diluent at a meeting point of the respective flows such that the flow of stock and the flow of diluent will combine into a resulting total flow of diluted stock which is the sum of the flows meeting each other, such that $Q_{tot}=Q_s+Q_d$ where $Q_s$ is the volume flow of stock, $Q_d$ is the volume flow of diluent and $Q_{tot}$ is the resulting total volume flow of diluted stock downstream of the meeting point.

Since it is to be expected that the stock in each conduit will not be diluted to the same extent, it is of the greatest importance that the feeding of a diluent into the stock will not affect the total volume flow of stock or diluted stock downstream of the meeting point between the respective flows. If the total volume flow of diluted stock reaching the slice lip is not uniform in the cross-machine direction, this will cause crossflows that will affect fiber orientation. Therefore, it has been recognized that when a diluent is fed into the stock on its way to the slice gap, steps must be taken in order to ensure that the total volume flow of diluted stock in a stock conduit remains constant regardless of the size of the volume flow of the diluent which is fed into the flow of stock, such that downstream of the point where a diluent is fed into the stock, the volume flow of diluted stock will be the same in each stock conduit.

A solution to the above-mentioned problem is disclosed in U.S. Pat. No. 5,316,383 (Begemann et al.). According to this document, a first volume flow of liquid (e.g., stock) coming through a first inlet line is met by and mixed with a second volume flow of liquid (e.g., a diluent, such as water or diluted stock) coming through a second inlet line. The two liquids mix with each other at a meeting point and form a resulting total volume flow of mixed liquid. The first inlet line is disposed at a mixing angle relative to the second inlet line and the mixing angle is chosen such that the resulting total volume flow of mixed liquid remains constant. According to this document, the solution to the above-mentioned problem thus lies in the proper selection of the mixing angle. The preferred mixing angle for one embodiment is specified as 80°. This document also describes experiments with different mixing angles which demonstrate that, at a mixing angle of 90°, an increase of the second volume flow will result in a decrease of the total volume flow of mixed liquid.

A different solution to the problem of achieving a constant volume flow of mixed liquid is disclosed in the above-mentioned '091 patent to Hergert. According to this document, a headbox apparatus is provided with a tapered inlet, or stock header, for the flow therethrough of stock. The upstream end of a tube bank having a plurality of tubes for the flow therethrough of stock is connected to the tapered inlet such that stock flows through the tapered inlet and from the inlet through the upstream end of the tube bank to a downstream end of the tube bank. A plurality of supply conduits for a diluent, such as fresh water or white water, are connected to the upstream end of the tube bank. Each supply conduit has a termination disposed closely adjacent and upstream relative to an upstream tube in the tube bank. In FIG. 6 of the '091 patent, the termination of the supply conduits is shown as being located in a wall of the tapered inlet, such that a supply conduit will feed a diluent directly into the stock at a location upstream of the upstream end of a tube in the tube bank. According to the '091 patent, when a diluent, such as water, flows through the termination and into the stock, the stock flowing through a tube adjacent the termination will be diluted, but the flow rate through the tube will not be changed. In this case, the constancy of the flow rate is due to the fact that the diluent is fed into the stock upstream of the tube.

Each of the above-mentioned solutions offers a possibility to dilute stock flowing through a tube without affecting the total volume flow of the stock through the tube. However, the known solutions are not always satisfactory. For example, the solution according to the '091 patent entails a potential risk that the diluent can not be fed into the stock with complete accuracy since the diluent is fed directly into the tapered inlet, or stock header, at a point upstream of the tube ends where it could possibly fail to reach the correct tube end. Furthermore, there is a possibility that the feeding of a diluent directly into the stock header might cause pressure variations in the header that might affect the flow in the stock conduits. The solution according to the '383 patent requires a specially designed connection between the inlet lines of the respective volume flows since the flows must meet each other at the correct angle and the required slanted connection is, from a manufacturing point of view, not the simplest design.

Therefore, there is a need for an easily applied solution to the problem of feeding a volume flow of a diluent into a volume flow of stock such that the flow of stock and the flow of diluent will form a resulting total volume flow of diluted stock where changes in the volume flow of the diluent will not affect the resulting total volume flow of diluted stock. There is also a need for an arrangement for diluting stock which is simple to manufacture. In addition, there is a need for an arrangement for diluting stock which ensures a good mixing of the stock and the diluent. There is furthermore a need for an arrangement for feeding stock to a headbox which allows an easy installation under various conditions.

SUMMARY OF THE INVENTION

The primary object of the invention is to accomplish, in an arrangement for feeding stock to a headbox, an easily applied solution to the problem of feeding a volume flow of a diluent into a volume flow of stock such that the flow of stock and the flow of diluent will form a resulting total volume flow of diluted stock where changes in the volume flow of the diluent will not affect the resulting total volume flow of diluted stock. The primary object of the invention is attained by the present invention, which is directed to an arrangement for feeding stock to a headbox in a papermaking machine.

The arrangement comprises at least one stock header for feeding stock to an inlet end of a headbox where the stock header has an inlet for receiving stock into the header and a plurality of outlets permitting stock to leave the header. For each stock header outlet, there is a stock conduit downstream of the stock header outlet permitting stock to pass from the outlet of the stock header through the conduit to the inlet end of a headbox, thereby connecting the outlet of the stock header to the inlet end of the headbox. The arrangement further comprises at least one dilution header for feeding a diluent to the plurality of stock conduits connecting the outlets of the stock header to the inlet end of the headbox, the dilution header having an inlet for receiving a diluent into the dilution header and a plurality of outlets permitting the diluent to leave the dilution header. The diluent may be, for example,-water, white water or diluted stock.

For each dilution header outlet, there is a diluent conduit permitting a diluent to pass from the dilution header through the diluent conduit to one of the plurality of stock conduits downstream of the stock header and into the stock passing through the stock conduit. Each diluent conduit has an upstream end connected to an outlet of the dilution header and a downstream end connected to and leading into one of the stock conduits. According to the invention, the downstream end of each diluent conduit is connected to one of the stock conduits at an upstream end of the stock conduit, and at a location immediately downstream of the outlet from the stock header. Thereby, a diluent may be fed into the stock at a location downstream of and in spaced adjacency to an outlet from the stock header. Furthermore, the stock header outlets are designed in such a way that the velocity of the stock at the upstream end of the stock conduits is substantially equal to the velocity of the stock in the stock header.

We have found that the distance between the outlet from the stock header and the connection between the diluent conduit and the stock conduit is of crucial importance for the ability of variations in the flow of diluent to affect the total volume flow of diluted stock downstream of the connection between the stock conduit and the diluent conduit. The relationship between this distance and the ability of diluent flow variations to cause variations in the total volume flow of diluted stock will now be discussed.

When stock passes through the stock conduits downstream of the outlets of the stock header, pressure losses due to friction in the conduits will occur. The greater the distance between the outlet from the stock header and the connection between the diluent conduit and the stock conduit, the greater the pressure loss before the diluent is fed into the stock. A large pressure drop will result in a large pressure difference between the outlet from the stock header and the point in the stock conduit where the diluent is fed into the stock. When a volume flow of a diluent is fed into the stock conduit, this will tend to affect the pressure in the stock conduit. Since it is to be expected that different diluent conduits will feed different amounts of diluent to their associated stock conduits, the pressure in each separate stock conduit will be affected to a different degree than the pressure in neighboring stock conduits. As a consequence thereof, the volume flow downstream of the connection between the stock conduit and the diluent conduit will not be the same in all stock conduits.

However, we have found that when the distance between the outlet from the stock header and the connection between the stock conduit and the diluent conduit is small, and the pressure loss is also small so that the pressure in the stock conduit at the location where the diluent is fed into the stock is almost the same as the pressure in the stock header itself, the feeding of a flow of diluent into the stock conduit will only have a marginal effect on the pressure in the stock conduit. As a consequence, the volume flow of diluted stock downstream of the connection between the stock conduit and the diluent conduit will be affected only to a marginal degree and the volume flow of diluted stock will remain substantially constant regardless of any variations in the flow of diluent into the stock conduit. We have found that the smaller the distance and the pressure drop between the outlet of the stock header and the connection between the conduits is, the less will variations in the flow of diluent which is fed into the stock be able to cause variations in the volume flow of diluted stock passing through the stock conduit. In theory, the distance should preferably be zero, or close to zero, which would correspond to no pressure loss at all between the outlet of the stock header and the connection between the stock conduit and the diluent conduit. However, in practice there will usually be a certain distance between the outlet from the stock header and the connection between the stock conduit and the diluent conduit. However, we have found that this distance should not exceed 0.15 meters which corresponds to a pressure loss of no more than 1 kilopascal when the pressure in the stock header is in the order of 300 kilopascals. The term "immediately downstream of" should therefore, in the context of this application, not be understood as necessarily meaning that there is no distance at all between the outlet of the stock header and the connection between the stock conduit and the diluent conduit.

According to the invention, the velocity of the stock in the upstream end of the stock conduits should be substantially equal to the velocity of the stock in the stock header itself. To this end, the stock header is tapered such that the cross sectional area of the stock header decreases in the direction of flow of the stock in the stock header and the diameter of the stock header outlets and the upstream end of the stock conduits is chosen such that the cross sectional area of the stock header outlets and the cross sectional area of the upstream end of a stock conduit is equal to the decrease in cross sectional area of the stock header between two stock header outlets; i.e., the difference in cross sectional area of the stock header between two stock header outlets is equal to the cross sectional area of each stock header outlet and equal to the cross sectional area of the upstream end of each stock conduit.

When the static pressure in the stock header is substantially the same in both ends of the stock header, this dimensioning of the stock header tapering will give the result that the velocity of the stock in the upstream end of the stock conduits will be substantially equal to the velocity of the stock in the stock header. We have found that when the velocity of the stock in the upstream end of a stock conduit is equal to the velocity of the stock in the stock header and more specifically, when the velocity of the stock in the stock conduit at the point where a diluent is fed into the stock is equal to the velocity of the stock in the stock header, the feeding of a diluent into the stock will have a relatively small effect on the resulting total flow of diluted stock such that variations in the volume flow of a diluent being fed into the volume flow of stock will only cause negligible variations in the total volume flow of diluted stock.

Advantageously, those stock conduits being connected to a diluent conduit will comprise, at a location downstream of the connection between the stock conduit and the diluent conduit, a throttle valve in order to generate turbulence and thereby assure that the stock and the diluent are properly mixed with each other. To further ensure a good mixing between the stock and the diluent, the stock conduits are given such a length that friction losses in the conduits will cause additional turbulence.

The stock conduits preferably all comprise flexible hoses which permits the stock header to be placed in many different positions relative to the headbox, thereby enabling the arrangement to be installed with greater ease.

DETAILED DESCRIPTION OF THE ILLUSTRATED EMBODIMENT

Figure 1:
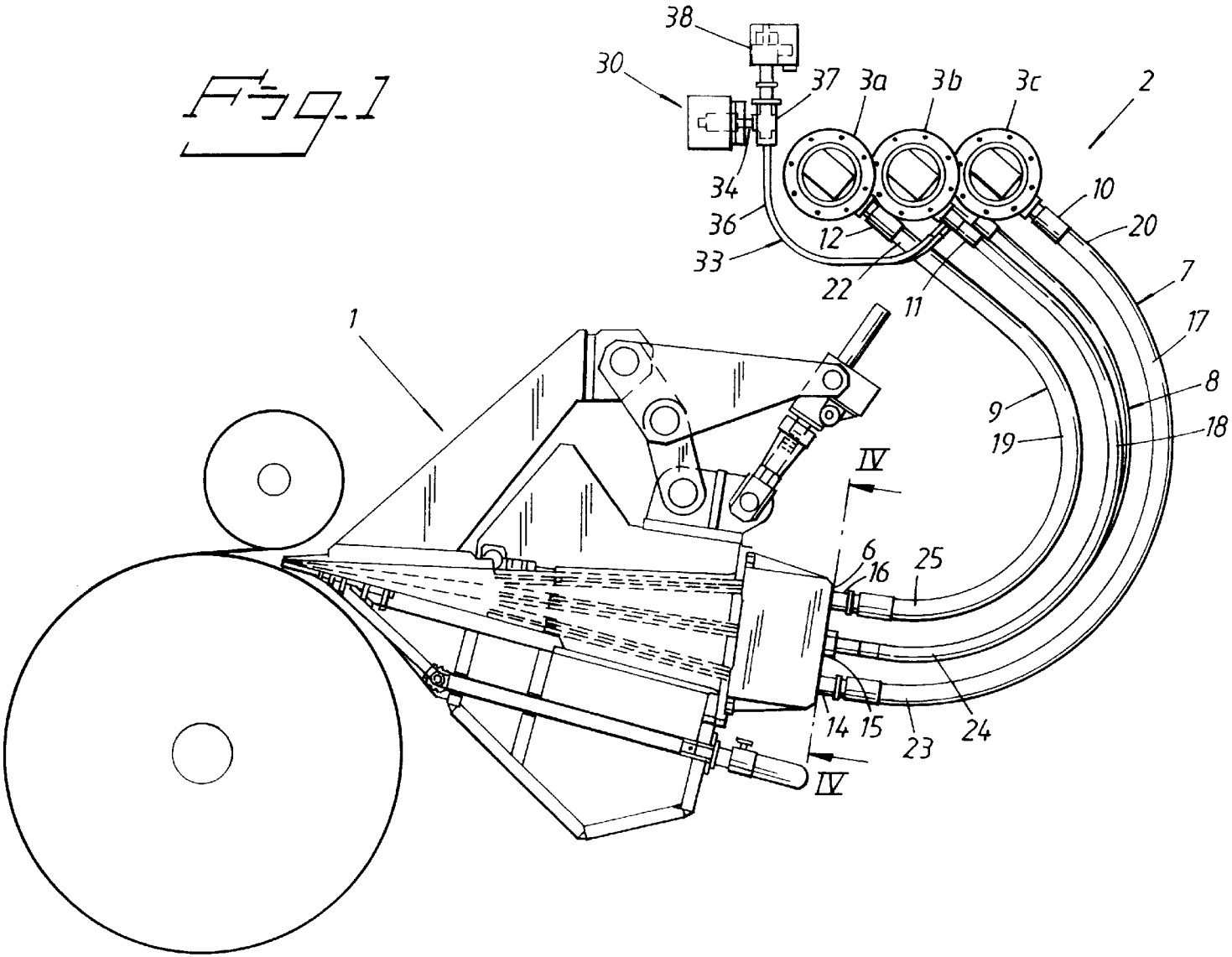
FIG. 1 is a schematic side view of a headbox with an arrangement for feeding stock to the headbox.
Figure 2:
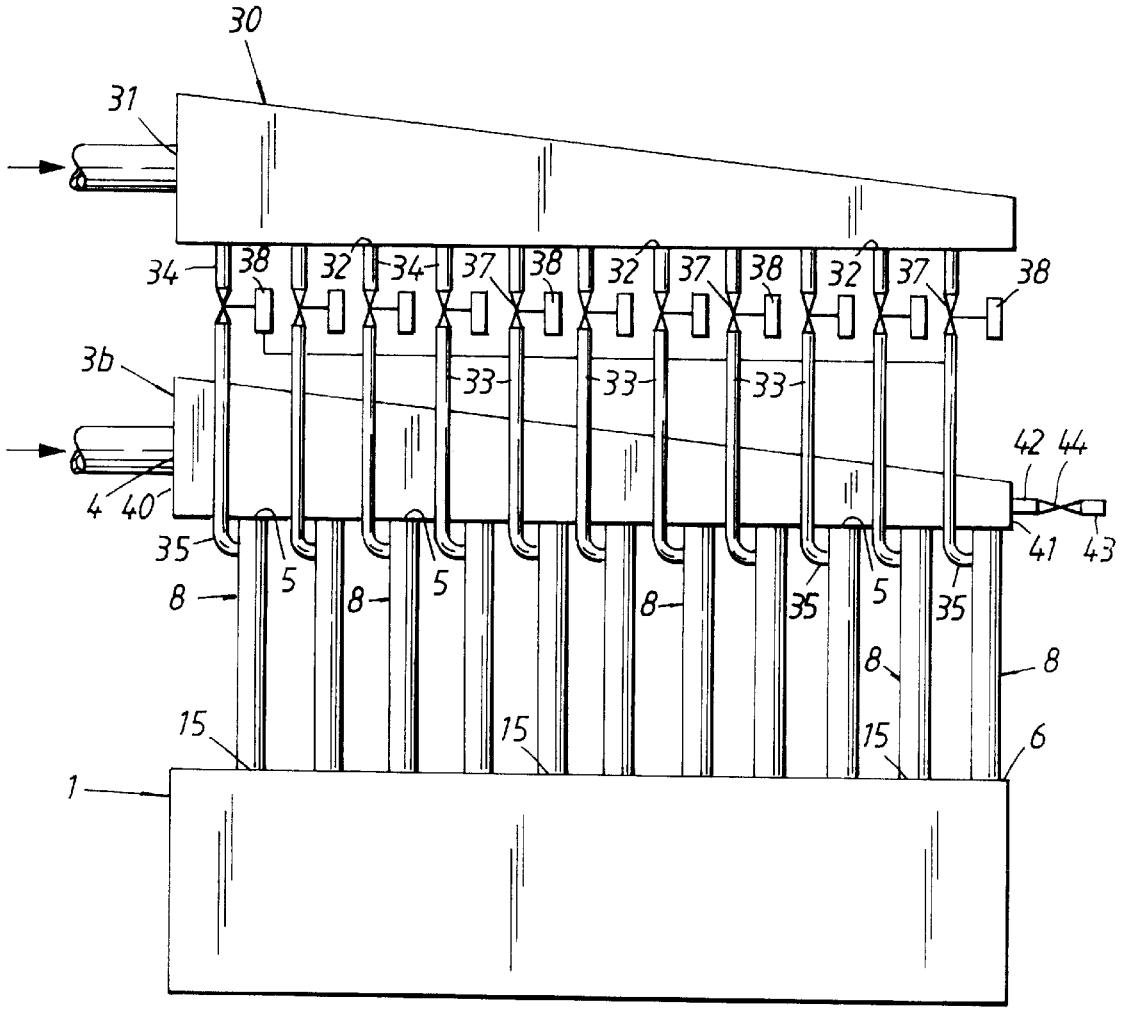
FIG. 2 is a schematic view from above of the headbox and a part of the arrangement for feeding stock shown in FIG. 1.

With reference to FIG. 1 and FIG. 2, a headbox with an arrangement for feeding stock to the headbox is shown. A headbox, generally designated 1, is fed with stock by an arrangement 2 for feeding stock to the headbox. The arrangement for feeding stock to the headbox comprises at least one stock header 3*a*, 3*b*, 3*c* for feeding stock to an inlet end of the headbox. In FIG. 1, three stock headers 3*a*, 3*b*, 3*c* are shown in an arrangement for feeding stock to a three-layer headbox. In this case, each stock header would be arranged to feed stock exclusively intended for one of the three layers of the web produced by the paper machine employing the three-layer headbox.

Each stock header 3*a*, 3*b*, 3*c* has an inlet 4 for receiving stock into the header and a plurality of stock header outlets 5 permitting stock to leave the header and enter an upstream end 10, 11, 12 of a plurality of stock conduits 7, 8, 9 each of which is connected to a stock header outlet 5. Each stock header outlet 5 is thus connected to the inlet end 6 of the headbox by a conduit 7, 8, 9 downstream of the stock header outlet, the conduits 7, 8, 9 permitting stock to pass from the outlet of the stock headers, through the stock conduits to the inlet end 6 of the headbox 1, thereby connecting the outlet 5 of the stock header 3*a*, 3*b*, 3*c* to the inlet end of the headbox 1 such that stock may pass from the stock header through the stock conduit 7, 8, 9 to the inlet end 6 of the headbox 1.

Each stock conduit 7, 8, 9 has an upstream end 10, 11, 12 connected to an outlet 5 of a stock header and a downstream end 14, 15, 16 connected to, or adapted to be attached to, the inlet end 6 of the headbox. The upstream end of each stock conduit has an intended general direction of flow of the stock from the stock header outlet 5 towards the inlet end 6 of the headbox and each upstream end 10, 11, 12 of a stock conduit 7, 8, 9 has a cross sectional area $A_3$ which is perpendicular to the intended general direction of flow through the upstream end 10, 11, 12 of the stock conduit 7, 8, 9 and which cross sectional area is equal to the cross sectional area of the stock header outlet 5. The conduits 7, 8, 9 comprise tubes or tubular elements 17, 18, 19 having an inner wall defining a channel for the passage therethrough of stock or diluted stock. Each tube or tubular element 17, 18, 19 has an upstream end 20, 21, 22 and a downstream end 23, 24, 25.

The tubes or tubular elements are advantageously all flexible hoses having a length of at least 2 meters. The fact that the stock headers 3*a*, 3*b*, 3*c* are all connected to the headbox 1 by flexible hoses 17, 18, 19 ensures that the stock headers 3*a*, 3*b*, 3*c* can be easily installed in a variety of different positions in relation to the headbox 1. Since the flexible hoses 17, 18, 19 have a length of at least 2 meters, considerable pressure losses will occur during the passage therethrough of diluted stock which in turn will cause turbulence that ensures a good mixing of the stock and the diluent. The length of the hoses 17, 18, 19 also contribute to an easy installation of the stock headers 3*a*, 3*b*, 3*c* at a variety of different positions relative to the headbox 1.

Figure 3:
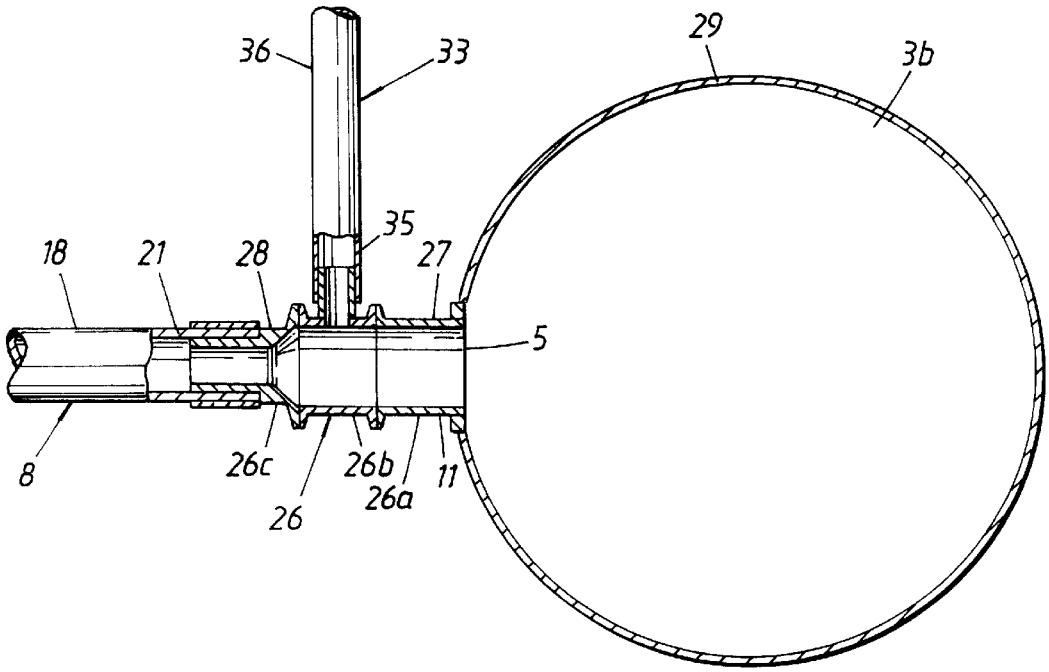
FIG. 3 is a cross sectional view through a stock header showing in greater detail the stock header, an outlet from the stock header and the connection between a stock conduit and a diluent conduit.

With reference to FIG. 3, each stock conduit 7, 8, 9 comprises, at its upstream end, a tubular coupling 26, the tubular coupling 26 having an upstream end 27 connected to the outlet 5 of a stock header 3*a*, 3*b*, 3*c* and a downstream end 28 connected to an associated tubular element 17, 18, 19. In FIG. 3, the tubular coupling 26 is shown as being made up of three elements 26*a*, 26*b* and 26*c*, where the element 26*a* is located at the upstream end 27 of the tubular coupling 26 and secured to the wall 29 of the stock header 3*a*, 3*b*, 3*c* at the outlet 5 of the stock header. The element 26*c* is located at the downstream end 28 of the coupling 26 and connects the coupling 26 to an associated tubular element 17, 18, 19. The element 26*b* is an intermediate element between the elements 26*a* and 26*c* and connects the elements 26*a* and 26*c* to each other. The element 26*b* may be adapted to be connected to the downstream end of a conduit for feeding a diluent into the stock passing through the stock conduit. To this end, the intermediate coupling element 26*b* is made as a T-connection.

With reference to FIG. 1 and FIG. 2, a dilution header 30 is shown. The dilution header 30 has an inlet 31 for receiving a diluent into the dilution header 30 and a plurality of outlets 32 permitting the diluent to leave the dilution header 30. The dilution header 30 is intended to feed a diluent to a plurality of stock conduits 7, 8, 9 connecting the outlets of a stock header 3*a*, 3*b*, 3*c* to the inlet end 6 of the headbox. For each dilution header outlet 32, there is a diluent conduit 33 downstream of the dilution header outlet 32 permitting a diluent to pass from the dilution header outlet 32 through the diluent conduit 33 to one of the stock conduits 7, 8, 9 downstream of the stock header 3*a*, 3*b*, 3*c* and into the stock passing through the stock conduit 7, 8, 9. Each of said diluent conduits 33 has an upstream end 34 connected to an outlet 32 of the dilution header and a downstream end 35 connected to one of the stock conduits 7, 8, 9 through a connection 26*b* at the upstream end 10, 11, 12 of the stock conduit 7, 8, 9. The connection is preferably in the form of a T-connection 26*b*.

According to the invention, the downstream end 35 of each diluent conduit is connected to the upstream end 10, 11, 12 of a stock conduit 7, 8, 9 at a location immediately downstream of the outlet 5 associated with that particular stock conduit so that the diluent may pass from the dilution header 30 through the diluent conduit 33 and into the stock conduit 7, 8, 9 at a location immediately downstream of the outlet 5 from the stock header 3*a*, 3*b*, 3*c*. The term "immediately downstream of" should, in the context of this application, not be understood as meaning that the distance between the stock header outlet and the connection between the diluent conduit and the stock conduit 7, 8, 9 necessarily is zero. In practice, there is usually going to be a certain distance between said connection and the stock header outlet. However, this distance should be kept as small as possible and not exceed 0.15 meters. Thereby, the pressure loss that occurs in the stock conduit between the outlet 5 from the stock header 3*a*, 3*b*, 3*c* and the connection between the stock conduit 7, 8, 9 and the diluent conduit 33 will be kept low and not exceed 1 kilopascal. With a pressure in the stock header 3 in the order of approximately 300 kilopascals, the pressure at the point where a diluent is fed into the stock conduit 7, 8, 9 will therefore be the same as, or only a small fraction less than the pressure in the stock header 3*a*, 3*b*, 3*c*. As a result, variations in the flow of diluent will not be able to influence the total volume flow of diluted stock that flows through the stock conduit 7, 8, 9.

With reference to FIG. 1, each diluent conduit 33 comprises a pipe 36 through which the diluent is intended to flow, the pipe 36 having an upstream end 36*a* adjacent an associated outlet of the dilution header and a downstream end 35 connected to and discharging into the upstream end of a stock conduit such that a diluent can flow through the pipe into a flow of stock passing through the stock conduit. The diluent conduit 33 also comprises a valve means 37 upstream of the pipe 36 and downstream of the associated dilution header outlet. The valve means 37 has a channel through which the diluent is intended to flow from the dilution header to the pipe, the valve means thereby forming a connection between the dilution header outlet and the pipe.

The channel of the valve means 37 has a cross sectional area which is variable in a manner well known such that the flow of diluent through the valve means 37 to the pipe can be varied according to need. To this end, there is an actuator 38 for each valve means 37, the actuator 38 being arranged to vary a flow of diluent from the dilution header 3*b* to the stock conduit 8 by varying the cross sectional area of the channel through which the diluent is intended to flow. Each actuator 38 will increase or decrease the flow of diluent through the diluent conduit 8 in response to signals from a central processing unit (not shown) such as a computer, the signals to the actuators coming for example through a cable indicated by the numeral 39 in FIG. 2.

During operation of the paper machine, there will be, at a location downstream of the headbox 1, a scanning unit (not shown) which keeps track of any variations in cross-machine properties of the paper web. When such non-uniformities are discovered, a signal will be sent to a central processing unit which in turn emits a signal to one or several of the actuators. In response, the actuator or actuators 38 will act to decrease or increase a flow of diluent at one or several locations such that a paper web with uniform properties will be achieved.

According to the invention, it is also important that the velocity of the stock in the upstream end of the stock conduits is equal to the velocity of the stock in the stock header. We have found that when the velocity of the stock flowing through each stock header outlet 5 and the upstream end 10, 11, 12 of each stock conduit 7, 8, 9 is equal to the velocity of the stock in the stock header 3*a*, 3*b*, 3*c*, variations in a volume flow of a diluent being fed into the volume flow of the stock will be less able to cause variations in the total volume flow of diluted stock. The reason for this is not completely understood, however, experiments and flow simulations conducted by us have confirmed that such is the case. Therefore, the arrangement for feeding stock to a headbox is designed in such a way that the velocity of the stock flowing through the stock header outlets 5 and the upstream ends 10, 11, 12 of the stock conduits 7, 8, 9 can be made equal to the velocity of the stock in the stock headers 3*a*, 3*b*, 3*c*.

Figure 6:
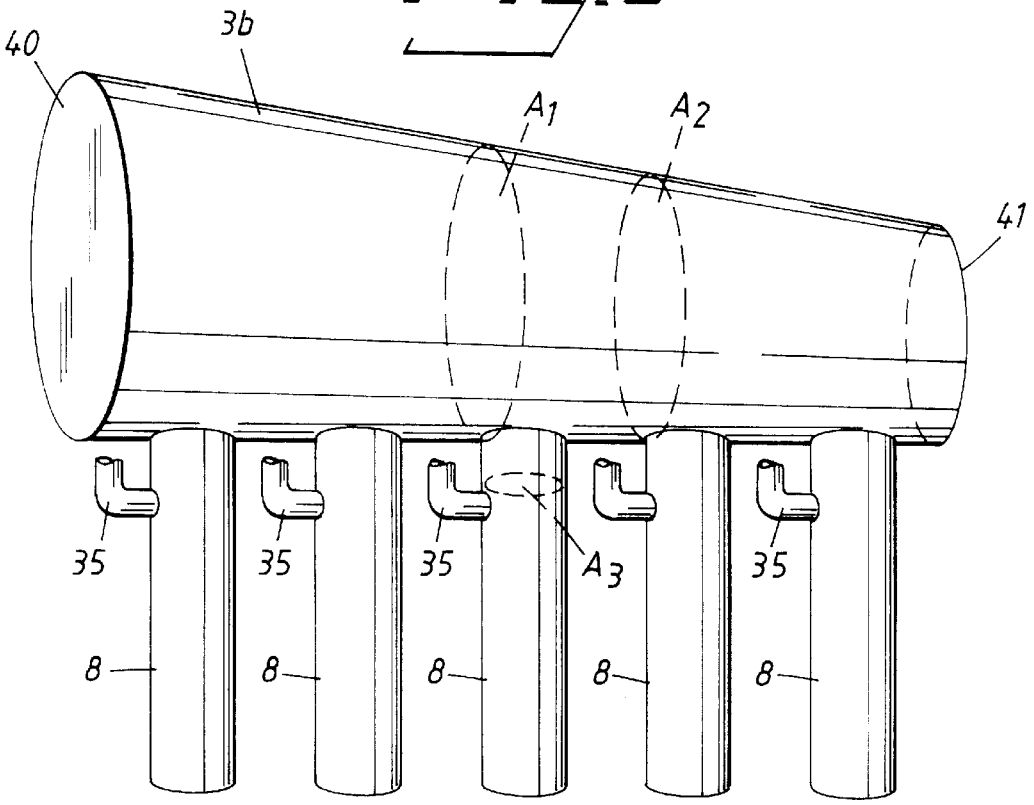
FIG. 6 is a schematic view from above showing in greater detail some of the elements shown in FIG. 3.

With reference to FIG. 3 and FIG. 6, the stock header 3*a*, 3*b*, 3*c* has a first end 40 and a second end 41 and has a longitudinal extension from the first end 40 to the second end 41, where the inlet 4 to the stock header permitting stock to enter the stock header 3*a*, 3*b*, 3*c* from a pressurized source of the stock is located at the first end 40 of the stock header 3*a*, 3*b*, 3*c*. A recirculation exit 42 is located at the second end 41 of the stock header permitting stock to leave the stock header and enter a recirculation conduit 43 through which approximately 5% of the stock is recirculated. Located at the recirculation exit 42, or immediately downstream of the recirculation outlet inside the recirculation conduit 43, there is a recirculation valve means 44 which can be adjusted in such a way that permits control of the static pressure at the second end 41 of the stock header 3*a*, 3*b*, 3*c*.

During operation of the arrangement 2 for feeding stock, stock will flow from the first end 40 of the stock header 3*a*, 3*b*, 3*c* to the second end 41 of the stock header while at every stock header outlet 5, a portion of the stock will leave the header through the stock header outlet 5. The stock header outlets 5 are, of course, placed in a row from the first end 40 of the stock header to the second end 41 of the stock header and the stock header outlets 5 are spaced from each other with a uniform spacing. The stock header outlets all have a cross sectional area $A_3$ which is equal for all stock header outlets 5. The stock will thus have a general direction of flow from the first end 40 of the stock header 3*a*, 3*b*, 3*c* to the second end 41 of the stock header 3*a*, 3*b*, 3*c* in such a way that the stock header can be described as having an intended general direction of flow for the stock from the first end 40 of the stock header to the second end 41 of the stock header and the stock flowing through the stock header will have a velocity.

When the stock flows through the stock header 3*a*, 3*b*, 3*c*, steps are taken to ensure that the velocity of the stock remains substantially constant from the first end 40 of the stock header to the second end 41 of the stock header 3*a*, 3*b*, 3*c*. This can be achieved by setting the valve means 44 at the recirculation exit 42 in such a way that the static pressure at the second end 41 of the stock header 3*a*, 3*b*, 3*c* is equal to the static pressure at the first end 40 of the stock header. By using Bernoulli's equation, it can be shown that if the static pressure is the same at both the first end 40 of the stock header 3*a*, 3*b*, 3*c* and the second end 41 of the stock header 3*a*, 3*b*, 3*c* and if pressure losses due to friction in the stock header are small enough to be ignored, the velocity of the stock will be substantially unchanged from the first end 40 of the stock header to the second end 41 of the stock header.

With reference to FIG. 6, the stock header has a cross sectional area in a plane which is perpendicular to the intended general direction of flow of the stock through the stock header. The stock header 3*a*, 3*b*, 3*c* is tapered such that the cross sectional area of the stock header decreases from the first end 40 of the stock header to the second end 41 of the stock header 3*a*, 3*b*, 3*c*. As can be seen in FIG. 6, the stock header has, at a point where one of the stock header outlets 5 is located, a first cross sectional area, $A_1$ and at the following stock header outlet 5 a second cross sectional area, $A_2$ which is smaller than the first cross sectional area $A_1$. Each stock header outlet 5 and the upstream end 10, 11, 12 of its associated stock conduit 7, 8, 9 has a cross sectional area, $A_3$ which is perpendicular to the general direction of flow of the stock through the upstream end 10, 11, 12 of the stock conduit 7, 8, 9. Along the length of the stock header 3*a*, 3*b*, 3*c*, from the first end 40 of the stock header to the second end 41 of the stock header, the tapering of the stock header 3*a*, 3*b*, 3*c* is such that $A_1-A_2=A_3$. In other words, between each two neighboring stock header outlets 5, the cross sectional area of the stock header 3*a*, 3*b*, 3*c* is reduced and the reduction of the cross sectional area is equal to the cross sectional area of each stock header outlet 5 which in turn is equal to the cross sectional area of the upstream end 10, 11, 12 of each stock conduit 7, 8, 9.

By analyzing the flows in the stock header 3*a*, 3*b*, 3*c* and the stock conduits 7, 8, 9, it can be shown that if the velocity of the stock flowing from the first end 40 of the stock header 3*a*, 3*b*, 3*c* to the second end 41 of the stock header is substantially constant, and if the cross sectional area of each stock header outlet 5 and the cross sectional area of the upstream end 10, 11, 12 of each stock conduit 7, 8, 9 is equal to the reduction of the cross sectional area of the stock header between each two neighboring stock header outlets 5, the velocity of the stock flowing through the upstream end 10, 11, 12 of each stock conduit 7, 8, 9 will be substantially equal to the velocity of the stock in the stock header as the stock flows from the first end 40 of the stock header 3*a*, 3*b*, 3*c* to the second end 41 of the stock header. It is to be noted that the term "equal to"; should be understood as meaning "equal in size" since the velocity of the stock flowing through the stock header 3*a*, 3*b*, 3*c* will have a direction that is substantially normal to the direction of the velocity of the stock flowing through the upstream end 10, 11, 12 of a stock conduit 7, 8, 9.

In order to achieve that a volume flow of a diluent can be fed into a volume flow of stock in such a way that variations in the size of the volume flow of the diluent will not cause variations in the resulting volume flow of diluted stock, we have thus found firstly that the diluent should be fed into the stock at a location immediately downstream of the stock header outlets 5 and, secondly, that the stock header 3*a*, 3*b*, 3*c* should be so designed that the velocity of the stock in the upstream end 10, 11, 12 of the stock conduits 7, 8, 9 should be substantially equal to the velocity of the stock in the stock header 3*a*, 3*b*, 3*c*. Each of these features will by itself contribute to the desired result. However, in the preferred form of the invention, both of these features are combined with each other and it is believed by us that the combination of these features have a synergistic effect such that they will reinforce each other.

Figure 5:
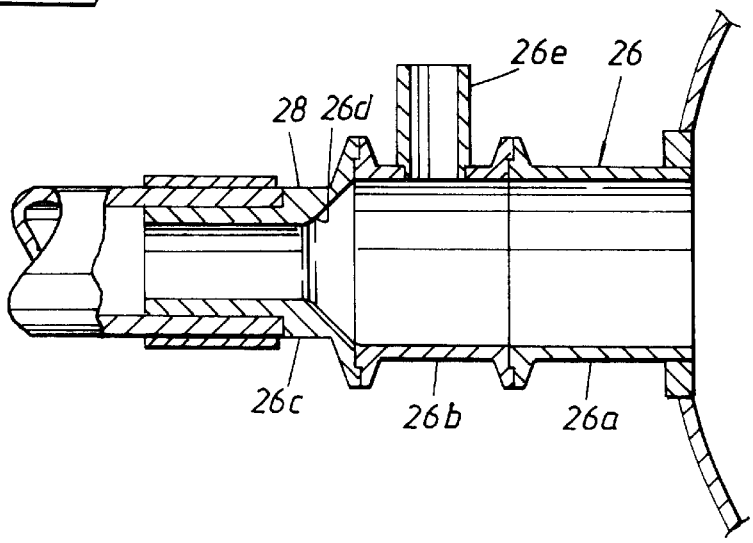
FIG. 5 is a view similar to FIG. 3 showing in greater detail some of the elements shown in FIG. 3.

When a diluent is fed into the flow of stock, it is important that the diluent will mix properly with the stock. As mentioned before, the length of the tubular elements 17, 18, 19 will contribute to the achievement of a good mixing between the two liquids. In addition, the coupling 26 connecting the stock header 3*a*, 3*b*, 3*c* with the tubular element 17, 18, 19 downstream of the stock header 3*a*, 3*b*, 3*c* comprises a throttle valve 26*d* downstream of the connection 26*b* connecting the diluent conduit 33 to the stock conduit 7, 8, 9. The throttle valve 26*d* will cause turbulence in the flow of diluted stock, thereby assuring that the diluent will be well mixed with the stock. With reference to FIG. 3 and FIG. 5, the throttle valve 26*d* is located in the downstream coupling element 26*c* and forms a part of the same.

FIG. 5 also shows in greater detail the connection between the downstream end 35 of a diluent conduit 33 and an upstream end 10, 11, 12 of a stock conduit. As can be seen in FIG. 5, the intermediate element 26*b* of the coupling 26 is formed as a 90° T-connection such that the element 26*b* has a longitudinal extension and a longitudinal axis in the general direction of flow of the stock through the element 26*b* (from right to left in FIG. 5) and the element 26*b* comprises a short tubular element 26*e* which extends transversely to the longitudinal axis of the intermediate element 26*b*. The downstream end 35 of a diluent conduit 33 will be connected to the short tubular element 26*e* such that a diluent may enter therethrough and into the stock conduit 7, 8, 9. The intermediate element 26*b* thereby forms a connection between the downstream end 35 of a diluent conduit 33 and an upstream end 10, 11, 12 of a stock conduit 7, 8, 9.

In a preferred embodiment of the invention, three stock headers 3*a*, 3*b*, 3*c* are used permitting stock to be fed to a multilayer headbox 1 of the kind designed to produce a fibrous web (not shown) having three layers. In this embodiment, each stock header 3*a*, 3*b*, 3*c* with its associated stock conduits 7, 8, 9 downstream of the stock header outlets 5 is arranged to feed stock intended exclusively for one of the three layers of the fibrous web. There will thus be a first stock header 3*a* which, together with its associated stock conduits 9, is arranged to feed stock intended exclusively for a first, top layer of the fibrous web, a second stock header 3*b* which, together with its associated stock conduits 8, is arranged to feed stock exclusively intended for a second, middle layer of the fibrous web and a third stock header 3*c* which, together with its associated stock conduits 7, is arranged to feed stock exclusively intended for a third, bottom layer of the fibrous web. In the preferred embodiment, the dilution header will be arranged to feed stock only to the stock conduits 8 connected to the second stock header 3*b* which is arranged to feed stock exclusively intended for the second middle layer of the fibrous web such that a diluent will be fed exclusively to the stock conduits 8 through which stock intended for the second, middle layer of the fibrous web passes. The web properties in the cross-machine direction will thus be regulated exclusively by regulating the consistency of the stock intended for the middle layer of the web.

Since control of the web properties is achieved exclusively by controlling the amount of diluent fed to the stock intended for the second, middle layer, it is important that, for the middle layer, fine adjustments can be made in sections of the headbox 1 having a small extension in a cross machine direction. Therefore, the tubular elements 18 of the stock conduits 8 connected to the second stock header 3*b* arranged to feed stock exclusively intended for the second, middle layer of the fibrous web are of greater number and smaller diameter than the tubular elements of the stock conduits 7, 9 connected to the first and third stock header 3*a*, 3*c* arranged to feed stock intended for the first, top layer of the web and the third, bottom layer of the web.

Figure 4:
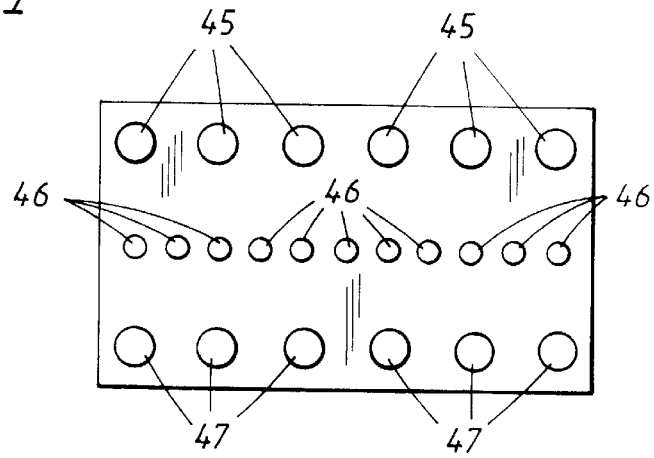
FIG. 4 is a cross sectional view along line IV—IV in FIG. 1.

With reference to FIG. 1, FIG. 3 and FIG. 4, the tubular elements 17, 18, 19 of the stock conduits 7, 8, 9 connected to the outlets 5 of each stock header 3*a*, 3*b*, 3*c* are flexible hoses 17, 18, 19 having an inner and an outer diameter and the flexible hoses 17, 19 of the stock conduits 7, 9 connected to the outlets of the first and third stock header 3*a*, 3*c* arranged to feed stock to the first and third layer of the fibrous web all have the same inner and outer diameter and the flexible hoses 18 of the stock conduits 8 connected to the outlets 5 of the second stock header 3*b* arranged to feed stock to the second layer of the fibrous web all have the same inner diameter and the same outer diameter. The inner diameter of the flexible hoses 18 of the stock conduits 8 connected to the second stock header 3*b* arranged to feed stock to the second layer of the fibrous web is smaller than the inner diameter of the flexible hoses 17, 19 of the stock conduits 7, 9 connected to the first and third stock headers arranged to feed stock to the first and third layer of the fibrous web.

With reference to FIG. 3 and FIG. 4, it can be seen that, at the inlet end 6 of the headbox 1, the downstream end of each of the flexible hoses 17, 18, 19 of the stock conduits 7, 8, 9 is connected to the inlet end of the headbox at a connection point 45, 46, 47. The connection points 45 of the downstream end of the flexible hoses 19 of the stock conduits 9 of the first stock header 3*a* are arranged in a straight horizontal row extending in a cross machine direction such that at the inlet end 6 of the headbox 1, the downstream end of the flexible hoses 19 of the stock conduits 9 connected to the first stock header are arranged in a first straight row extending in a cross machine direction. In the same way, the connection points 46 of the downstream end of the flexible hoses 18 of the stock conduits 8 of the second stock header 3*b* are arranged in a straight horizontal row extending in a cross machine direction such that, at the inlet end 6 of the headbox 1, the downstream end of the flexible hoses 18 of the stock conduits 8 connected to the second stock header 3*b* are arranged in a second straight row extending in a cross machine direction. Similarly, the connection points 47 of the downstream end of the flexible hoses 17 of the stock conduits 7 of the third stock header 3*c* are arranged in a straight horizontal row extending in a cross machine direction such that at the inlet end 6 to the headbox 1, the downstream end of the flexible hoses 17 of the stock conduits 7 connected to the third stock header 3*c* are arranged in a third straight row extending in a cross machine direction. The first, second and third row are vertically spaced from each other with the first row being placed vertically above the second and third rows, the second row being placed vertically below the first row and vertically above the third row and the third row being placed vertically below the first and second rows.

As can be seen in FIG. 4, each of the aforementioned first, second and third rows is so arranged that, for each row, the downstream ends of the flexible hoses 17, 18, 19 are, at the connection points 45, 46, 47 between the inlet end 6 of the headbox and the downstream end of the flexible hoses 17, 18, 19, spaced from each other in a cross machine direction. In each row, the downstream end of the flexible hoses 17, 18, 19 are spaced from each other with a uniform spacing. The spacing between the downstream end of the flexible hoses 18 in the second row, i.e., the flexible hoses 18 through which diluted stock passes, is smaller than the spacing between the downstream end of the flexible hoses 17, 19 in the first and third rows. The smaller spacing between the downstream end of the flexible hoses 18 of the second row provides for fine adjustments of stock consistency in sections having a small extension in a cross machine direction. In practice the spacing between the connection points of the flexible hoses of the second row will be approximately 50–70 mm and the inner diameter of the flexible hoses approximately 45 mm.

The invention permits a volume flow of a diluent to be fed into a volume flow of stock such that a resulting total volume flow of diluted stock will be constant regardless of variations in the volume flow of the diluent. Variations in the volume flow of the diluent will thus not cause variations in the resulting total volume flow of diluted stock. The components can be easily manufactured and to a degree, the invention can be easily applied to existing equipment. The invention also results in an excellent mixing of the diluent and the stock. Furthermore, the invention permits an easy installation of an arrangement for feeding stock to a headbox since the stock headers can be placed in a variety of different positions relative to the headbox thanks to the long flexible hoses used to connect the stock headers to the headbox.

That which is claimed is:

1. An apparatus for feeding diluted paper stock to a papermaking machine, said apparatus comprising:

(a) at least one stock header for feeding stock to the papermaking machine, said at least one stock header having an inlet end and an opposite recirculation end and defining a header flow direction extending therebetween, said header further defining a row of uniformly spaced outlets each having a predetermined cross sectional area for permitting stock to flow from the header in a direction generally perpendicular to the header flow direction, said stock header being tapered to define a cross sectional area which decreases from each outlet to the adjacent outlet in the header flow direction by an amount equal to the cross sectional area of each said outlet such that the flow velocity through the stock header is substantially equal to the flow velocity into each outlet;

(b) a recirculation conduit connected to a recirculation exit adjacent said recirculation end of said stock header;

(c) a recirculation valve located at the recirculation exit and permitting control of the static pressure at the recirculation end of said stock header;

(d) a stock conduit connected to each of said stock header outlets having an upstream end connected to the respective stock header outlet and a downstream end adapted to be attached to the inlet end of the papermaking machine, said stock conduits each having a predetermined inner cross sectional area equal to the cross sectional area of the connected stock header outlet;

(e) a dilution header for feeding a diluent to at least one of said stock conduits, said dilution header having an inlet and a plurality of outlets permitting the diluent to leave the dilution header; and (f) a diluent conduit connected to each of said dilution header outlet and permitting a diluent to pass from the respective dilution header outlet through said diluent conduit to one of said plurality of stock conduits for diluting the stock passing therethrough, each of said diluent conduits having an upstream end connected to the respective dilution header and a downstream end connected to the respective stock conduit.

2. An apparatus according to claim 1 wherein each diluent conduit is connected to the repective stock conduit at a predetermined location along the stock conduit, said location being immediately downstream of and less than about 0.15 meters from said outlet from said stock header.

3. An apparatus according to claim 2 wherein said diluent conduit is connected to said stock conduit at a location where the stock pressure in said stock conduit is less than the stock pressure at the respective stock header outlet by less than about 1 kilopascal.

* * * * *